US007191762B2

(12) United States Patent
Yudanov

(10) Patent No.: US 7,191,762 B2
(45) Date of Patent: Mar. 20, 2007

(54) FUEL INJECTION SYSTEM

(75) Inventor: Sergi Yudanov, Västra Frölunda (SE)

(73) Assignee: Volvo Lastvagnar AB, Gothenburg (SE)

( * ) Notice: Subject to any disclaimer, the term of this patent is extended or adjusted under 35 U.S.C. 154(b) by 0 days.

(21) Appl. No.: 10/708,655

(22) Filed: Mar. 17, 2004

(65) Prior Publication Data

US 2005/0000493 A1 Jan. 6, 2005

Related U.S. Application Data

(63) Continuation of application No. PCT/SE03/00435, filed on Mar. 14, 2003.

(60) Provisional application No. 60/319,538, filed on Sep. 9, 2002.

(30) Foreign Application Priority Data

Mar. 26, 2002 (SE) ..... 0200944

(51) Int. Cl.
*F02M 33/02* (2006.01)

(52) U.S. Cl. ..... 123/446; 123/456

(58) Field of Classification Search ..... 123/446, 123/447, 456, 506, 458, 514
See application file for complete search history.

(56) References Cited

U.S. PATENT DOCUMENTS

| | | | | |
|---|---|---|---|---|
| 3,544,008 | A | 12/1970 | Reiners | |
| 4,092,964 | A | 6/1978 | Hofer et al. | |
| 5,445,323 | A | 8/1995 | Perr et al. | |
| 6,247,450 | B1 | 6/2001 | Jiang | 123/446 |
| 6,439,202 | B1 * | 8/2002 | Carroll et al. | 123/467 |
| 6,651,626 | B2 * | 11/2003 | Rodriguez-Amaya et al. | 123/447 |
| 6,779,741 | B2 * | 8/2004 | Boehland | 239/88 |
| 6,808,124 | B2 * | 10/2004 | Egler | 239/88 |
| 2001/0023682 | A1 * | 9/2001 | Cornell et al. | 123/446 |
| 2003/0019478 | A1 * | 1/2003 | Gibson et al. | 123/456 |
| 2003/0089340 | A1 * | 5/2003 | Boehland | 123/446 |
| 2003/0131825 | A1 * | 7/2003 | Boehland et al. | 123/446 |

FOREIGN PATENT DOCUMENTS

| | | | |
|---|---|---|---|
| DE | 19923421 | A1 | 11/2000 |
| EP | 1036931 | A2 | 9/2000 |
| EP | 1087130 | A2 | 3/2001 |

* cited by examiner

*Primary Examiner*—Thomas Moulis
(74) *Attorney, Agent, or Firm*—Novak Druce & Quigg, LLP

(57) ABSTRACT

A fuel injection system for an internal combustion engine comprises a nozzle (2) with an inlet and a cam-driven plunger (5) forming a plunger chamber (7) which is connected to the inlet of the nozzle. The injection system also comprises a common rail (10) for fuel and a control valve (9) installed between the plunger chamber (7) and the common rail (10), wherein the control valve is able to open or close hydraulic communication between the plunger chamber and the common rail upon receiving an electrical control command. An electrically actuated nozzle control valve (21) is used for opening and closing of the nozzle (2). The system also comprises a means (11) for pressurizing the common rail and regulating pressure of the fuel in the common rail (10).

15 Claims, 11 Drawing Sheets

FUEL INJECTION SYSTEM

CROSS REFERENCE TO RELATED APPLICATIONS

The present application is a continuation patent application of International Application No. PCT/SE03/00435 filed 14 Mar. 2003 which was published in English pursuant to Article 21(2) of the Patent Cooperation Treaty. International Application No. PCT/SE03/00435 claims priority to Swedish Application No. 0200944-7 filed 26 Mar. 2002 and claims the benefit of U.S. Provisional Application Ser. No. 60/319,538 filed 9 Sep. 2002. Said applications are expressly incorporated herein by reference in their entireties.

BACKGROUND OF INVENTION

1. Technical Field

The present invention relates to apparatus for injecting fuel into internal combustion engines, particularly compression ignition engines.

2. Background

The common means of injecting fuel into modern diesel engines can be divided in two functionally different groups: mechanically actuated systems and common rail systems. The majority of heavy-duty diesel engines for commercial vehicles utilize mechanically actuated, electronically controlled unit injector/unit pump systems. The light duty diesel engine market is dominated by either pump-line-nozzle mechanically actuated fuel injection systems (FIE) or so called high pressure common rail systems.

There are several types of mechanically actuated unit injectors/pumps. All of them are capable of creating very high injection pressures with relatively good hydraulic/mechanical efficiency, which is one of their most important advantages over the common rail systems. Another advantage is significantly better durability. Durability of high pressure common rail systems is inferior to mechanically actuated systems largely due to constant exposure of its elements to maximum fuel pressure which is required for injection. Yet another significant advantage of mechanically actuated unit injection systems is their natural ability to achieve favorable injection rate development during a single injection. High pressure common rail systems cannot easily provide such injection characteristic and, when their inherent square-shaped injection trace pattern becomes desirable in some engine operating points, the contemporary unit injectors with a direct nozzle control valve can shape an injection in this way just as well. This affords the latter systems better flexibility in injection rate shaping.

On the other hand, high pressure common rail systems have certain advantages over the mechanically actuated injection systems. Among those most important for the commercial vehicle engines have almost unlimited injection timing flexibility and ease of achieving multiple injections. Such an ability of a fuel injection system gains importance with the introduction of various types of diesel exhaust aftertreatment devices and advances in the development of alternative combustion processes like HCCl. The reliance of the mechanically actuated systems on a cam driving the pumping plunger can significantly restrict their ability to fulfill the requirements to injection timing and fuelling of multiple injections. The other advantage of a high pressure common rail system over a mechanical unit injection system can be lower parasitic drive power losses when operating at very low engine loads and idle. At such conditions, high pressure common rail systems also have better accuracy of fuel delivery than a mechanically actuated unit injection system with a large plunger diameter. Finally, mechanically actuated unit injection systems can be a source of excessive mechanical noise generated by both the FIE itself and the drivetrain transmitting torque to actuate the system. Such excessive noise is especially conspicuous at engine idle. The operation of the high pressure common rail systems does not significantly contribute to the total engine noise at any operating point.

U.S. Pat. No. 6,247,450 by Jiang discloses a system consisting of a mechanically actuated unit injector with a control valve and a common rail. In that system, the common rail pressure is regulated at relatively low levels and the fuel under this pressure can be fed into the unit injector through a metering orifice that is opened at a certain retracted position of the plunger of the unit injector, and closed at other plunger positions. Variation of common rail pressure and the duration of opening of the metering orifice determine the amount of fuel filling the plunger chamber. During a pumping stroke of the plunger, the metering orifice is closed and fuel is pressurized in the plunger chamber, which is appropriately sized to allow for necessary injection pressure to be reached. The plunger chamber is connected to the inlet of a conventional spring-closed nozzle via a control valve. Upon reaching a required pressure level, the control valve can be opened to transmit the pressurized fuel to the nozzle and commence injection. To end injection, the valve closes and the nozzle is closed by the return spring.

Such a system relies on the plunger being stationary at the maximum lift and keeping the pressure created during the pumping stroke to provide flexibility in injection timing. Fuel injection cannot possibly take place during most of the retraction and pumping strokes of the plunger due to the metering orifice being closed. Clearly, the system is not designed to inject at any other time but when the plunger is close to the maximum lift, because even if the control valve were opened during the fuel metering phase and common rail pressure were set above the spring opening pressure of the nozzle, the pressure drop across the metering orifice that is necessary to achieve the fuel metering function of the system, would have prevented injection.

Apart from a restricted injection timing range, the system of the U.S. Pat. No. 6,247,450 suffers from a number of other drawbacks, namely, unfavorable shape of injection rate trace both in the beginning and end of injection, restricted range of injection pressures etc.

The other prior art FIE which can be considered relevant to the present invention is that referred to as pressure/time metering unit injection system introduced into the market by Cummins Inc. Examples of such system can be found in U.S. Pat. Nos. 3,544,008, 4,092,964 and 5,445,323. A system of this type contains a pressurized fuel common rail feeding unit injectors. However, the function of the common rail is not to directly inject fuel into the engine, but to facilitate fuel metering into the plunger chamber which will be displaced through the nozzle during the pumping stroke of the plunger. Such systems thus have a limited injection timing range and need to utilize the mechanical actuation every time an injection is due.

SUMMARY OF INVENTION

The subject of the present invention is a new mechanical unit injection system with common rail functionality. The purpose of the invention is to allow the mechanical injection actuation and the common rail principles to be used selectively at such conditions that permit utilization of their respective advantages, and to be selectively de-activated at other conditions where their respective drawbacks could adversely affect the performance of the engine.

A primary object of the invention is to provide a fuel injection system allowing the mechanical injection actuation and the common rail principles to be used selectively at such conditions that permit utilization of their respective advantages, and to be selectively de-activated at other conditions to avoid their respective disadvantages.

A more specific object of the invention is to provide a fuel injection system with an expanded range of possible injection timings compared to the known mechanically actuated injection systems, so that injection could occur at any point in engine's revolution; with an expanded range of possible injection pressures compared to what is feasible for the known high pressure common rail systems; and with an enhanced injection rate shaping capability. Such a system will allow an exclusive use of the common rail operating principle at idle and low loads to reduce the engine noise and an exclusive use of the mechanical actuation principle at such conditions where high injection pressure is necessary, thereby permitting the design of the common rail part of the system to be relatively simple and durable due to relatively low maximum rail pressure. Such a system will, using both operating principles by choosing an appropriate timing of energization of a control valve, be able to achieve a so-called "boot"-shaped injection in addition to other types of rate shaping which are known to be possible for mechanically actuated unit injectors and common rail systems, such as a square or triangular injection rate traces, pilot injections, high-pressure post injections and late post injections.

Another specific object of the present invention is to provide a fuel injection system that, in addition to the features described above, will have an intrinsic protection against system overpressure.

DETAILED DESCRIPTION

Figure 1:
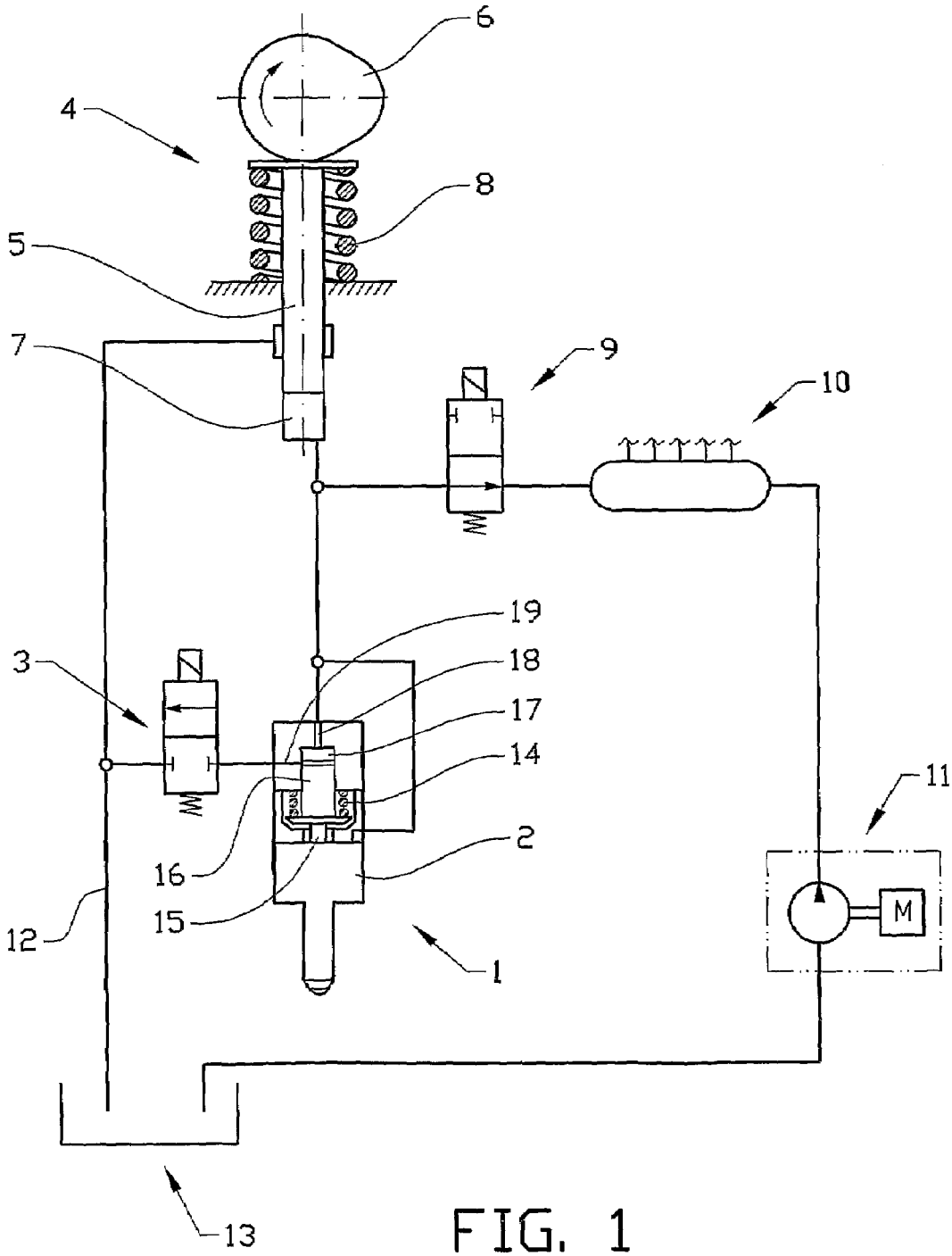
FIGS. 1 to 10 are diagrammatic views of various embodiments of the present invention which will be described in greater detail hereinbelow.

In accordance with a first embodiment of the present invention that is shown in FIG. 1, a fuel injector 1 there is provided that incorporates a conventional, normally closed nozzle 2 and an electrically operated nozzle control valve (NCV) 3. A mechanically actuated means 4 is also provided for pressurizing fuel and comprises (includes, but is not limited to) a cam-driven plunger 5 with a cam 6 and a plunger chamber 7. There is a return spring 8 and an electrically operated valve 9 and a common rail 10 typically serving a set of said fuel injectors and mechanically actuated means in an engine (not shown). There is also a means 11 for pressurizing the common rail and regulating pressure in it at a required level. A return line 12 is provided with a relatively low pressure and a fuel tank 13. An electronic control unit (not shown) governs the pressure in the common rail 10 and controls valves 3 and 9.

Fuel injector 1 is designed to operate as a high pressure common rail injector of the type well known from the prior art. As is typical to such known injectors, injector 1 contains a spring 14 biasing a needle 15 to close the nozzle 2; a control piston 16 with a control chamber 17 arranged such that higher pressure in the control chamber tends to urge the control piston to push onto the needle 15 to close the nozzle; an input throttle 18 and an outlet port 19. The input throttle 18 connects the control chamber 17 with the plunger chamber 7 and the outlet port 19 connects the control chamber with the NCV 3. The NCV can, upon receiving a command, open and connect the outlet port 19 to the return line 12. The flow areas of the input throttle, outlet port and the NCV are chosen such that an opening of the NCV causes a pressure drop in the control chamber that is sufficient to allow the pressure acting on a differential area of the needle 15 to open the nozzle 2. Also typical to the known high pressure common rail injectors, the outlet port 19 and the control piston 16 are designed such that the control piston is able to restrict the outlet port at a position corresponding to an open nozzle, thereby limiting the leakage of pressurized fuel through the input throttle 18, output port 19 and open control valve 3 to the return line 12.

The plunger chamber 7 is connected to the inlet of the nozzle 2. The plunger chamber can be connected to or disconnected from the common rail 10, depending on the state of the control valve 9.

The fuel injection system works as follows: the fuel pressure in the common rail 10 is maintained at a certain constant level that is set in accordance with requirements of a particular operating condition of the engine. When a high injection pressure is not required for the injection, for example, with the engine at idle or relatively low load point, the control valve 9 remains open throughout the entire engine cycle. During the pumping stroke of the plunger 5, the fuel is displaced through the control valve 9 back to the common rail such that there is very little pressure build-up in the plunger chamber 7 and, correspondingly, little wind-up of the engine transmission driving the plunger. To start an injection, the NCV 3 opens, the pressure in the control chamber 17 falls allowing the control piston 16 and the needle 15 to lift up and open the nozzle. Then, fuel is injected under the common rail pressure through the open nozzle, until the NCV is closed again. Following the closure of the NCV, the pressure in the control chamber 17 rises back to the level of the common rail pressure and the control piston 16, assisted by the spring 14, closes the nozzle. This mode of operation will be further referred to as the common rail or CR mode. It will be understood that for the CR operational mode to work, the difference between the pressures in the common rail 10 and the return line 12 should be bigger than the spring opening pressure of the nozzle 2, said spring opening pressure being defined by the pre-load of the spring 14 and the size of the differential area of the closed needle 15.

The CR operational mode allows to reduce the mechanical noise of the injection system by eliminating the windup and rapid release of the wound-up transmission driving the mechanical actuation means, that is characteristic to the mechanically actuated FIE and, particularly, unit injectors. The availability of the common rail pressure also allows for fuel injection at any point of the engine cycle. Maximum design limit on the working pressure in the common rail will be a compromise between the cost, useful life and other parameters limiting maximum pressure on one hand and, on the other hand, the benefits such as injection timing flexibility, noise reductions and other improved engine characteristics. Thus, a typical maximum working pressure in the common rail can be between 200 and 600 bar.

When a higher injection pressure is required, the control valve 9 is briefly closed during the pumping stroke of the plunger 5. This will cause a pressure increase in the plunger chamber 7, at the input throttle 18 and the inlet of the nozzle 2. When a certain desired pressure is achieved, the NCV opens and injection takes place as described above. The end of injection depends on the relative timing of closing of the NCV and opening of the control valve 9. This mode of operation resembles the functional sequence of electronically controlled mechanically actuated unit injectors known in the prior art and will be further referred to as the EUI mode of operation. By means of utilizing the EUI mode of operation the present invention can achieve very high injection pressures that are characteristic to the known unit injector and unit pump systems. At the same time, the present invention does not have the drawbacks of the high pressure common rail systems associated with having very high pressure in the common rail and other volumes, because the high pressure is kept to relatively small volumes by the closed control valve 9. In fact, the common rail pressure during the EUI operational mode can be reduced down to a very low lever that is just enough to ensure reliable filling of the plunger chamber 7 during the retraction stroke of the plunger, typically between 4 and 6 bar.

Figure 2:
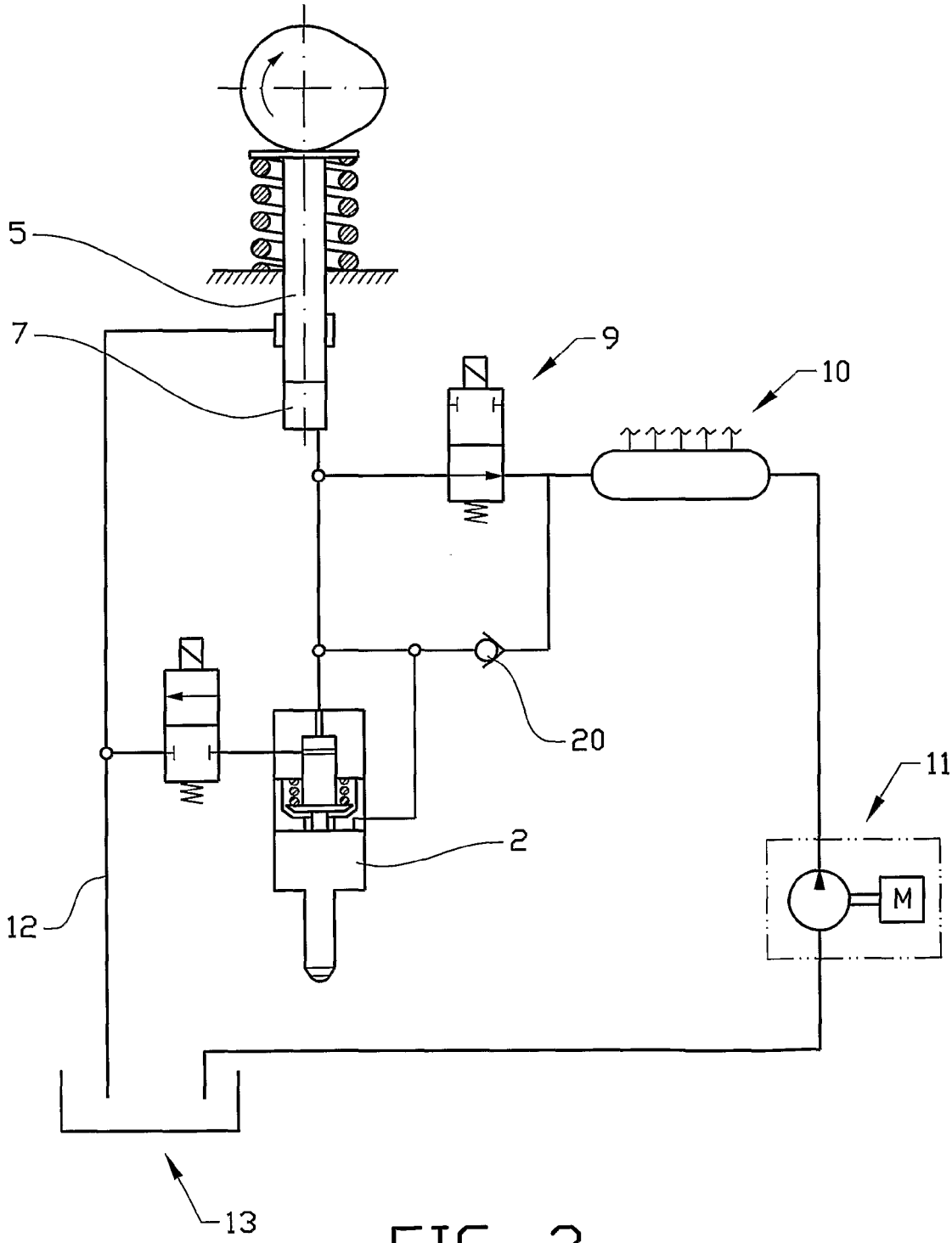

In another embodiment of the present invention shown in FIG. 2, the system is designed in the same way, but a non-return valve 20 is installed between the inlet of the nozzle 2 and the common rail 10, with its input connected to the common rail. Valve 20 opens during the return or retraction stroke of the plunger 5 to reduce the pressure drop between the plunger chamber 7 and the common rail, which in the absence of the valve 20 could lead to too low a pressure at the inlet of the nozzle 2 for the CR mode of injection to work. The valve 20 is therefore employed to allow for an injection during the retraction stroke of the plunger. Alternatively, it permits the use of a control valve 9 with a smaller flow area. That, in turn, can improve the control valve's response times, reduce its dimensions, electrical power consumption etc.

Figure 3:
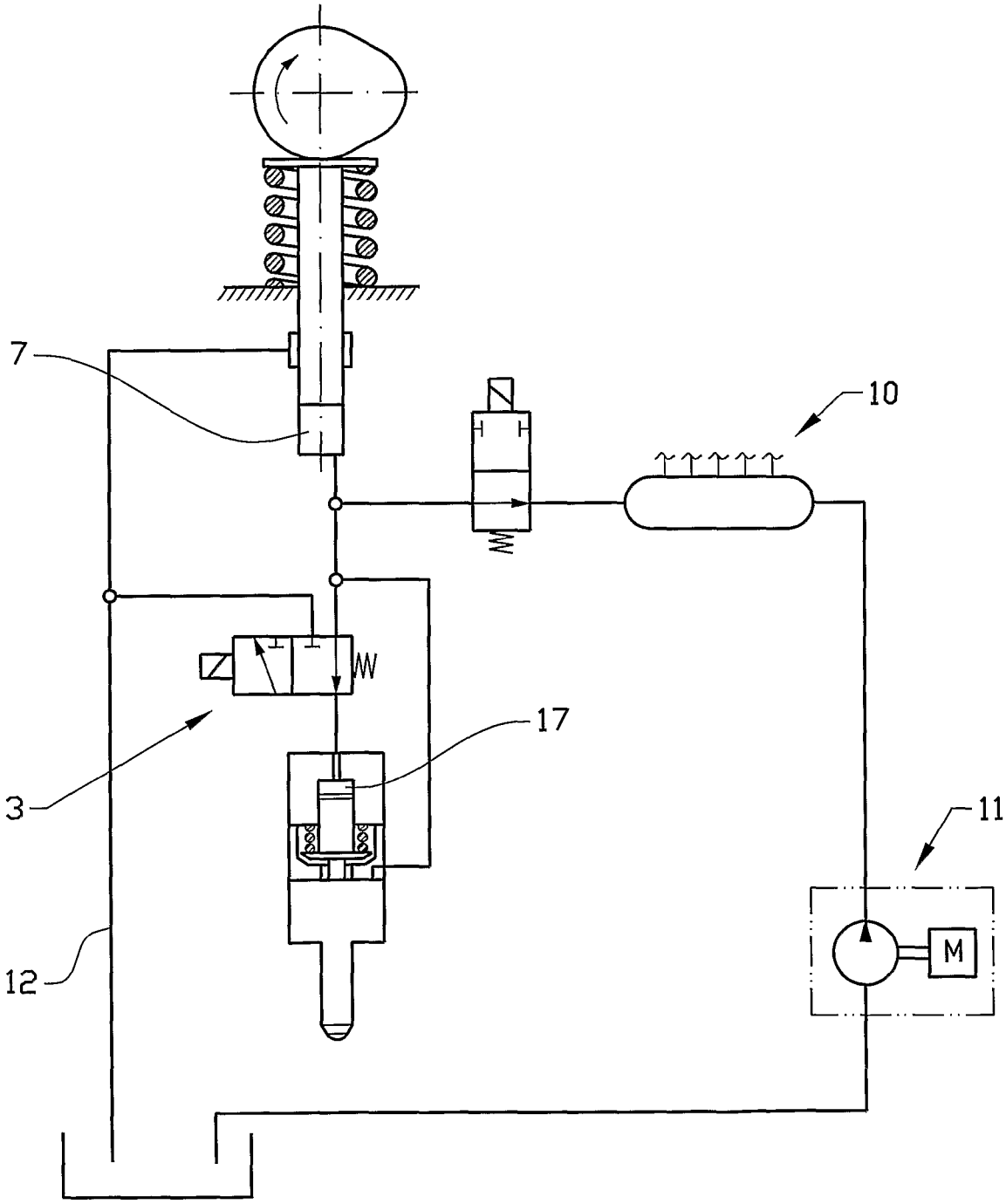
Figure 4:
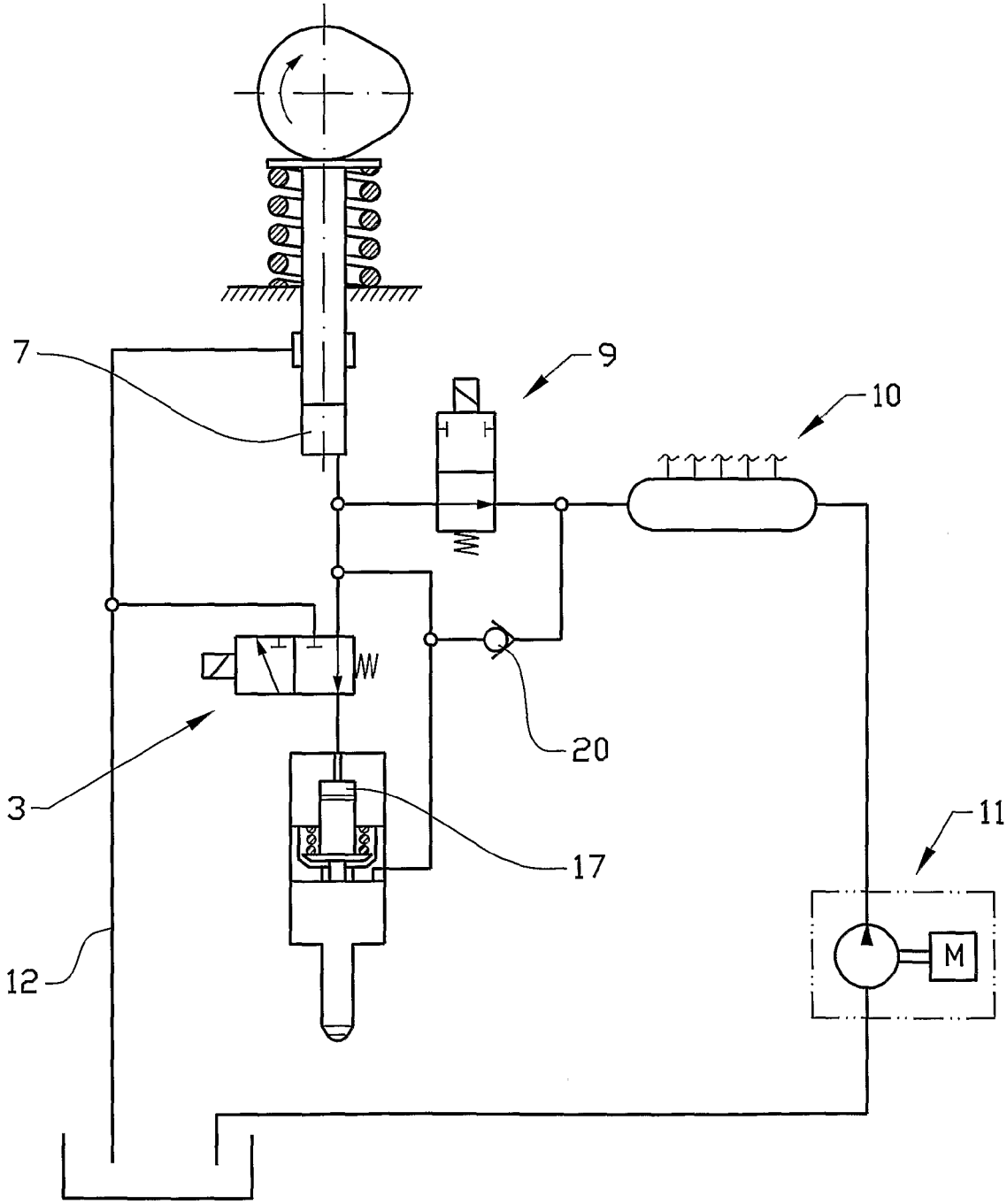

The above described principle for controlling the movement of the needle 15 can be inadequate when a higher needle opening and closing velocity is required. That can be overcome by the use of a three-way valve and suitable modification of the hydraulic circuit. The FIGS. 3 and 4 show another embodiment of the invention in which a three-way needle control valve 3 is installed between the plunger chamber 7 and the control chamber 17. The control chamber's only connection is to the NCV, which can alternatively connect the control chamber 17 to the source of pressure (as shown in the figure) or to the return line 12 with low pressure. Opening of the NCV closes the connection of the control chamber to the source of pressure and opens the return line connection, so that the fuel can be evacuated quickly allowing for a faster opening of the needle. Closing of the NCV disconnects the control chamber 17 from the return line and reconnects it to the pressure source, which can also close the nozzle faster.

Identically to the embodiment shown in FIG. 2, a non-return valve 20 connected by its inlet to the common rail and outlet to the nozzle 2 may be used as shown in FIG. 4 to expand the range of possible injection timings of the system and reduce the maximum necessary flow area of the control valve 9.

Figure 5:
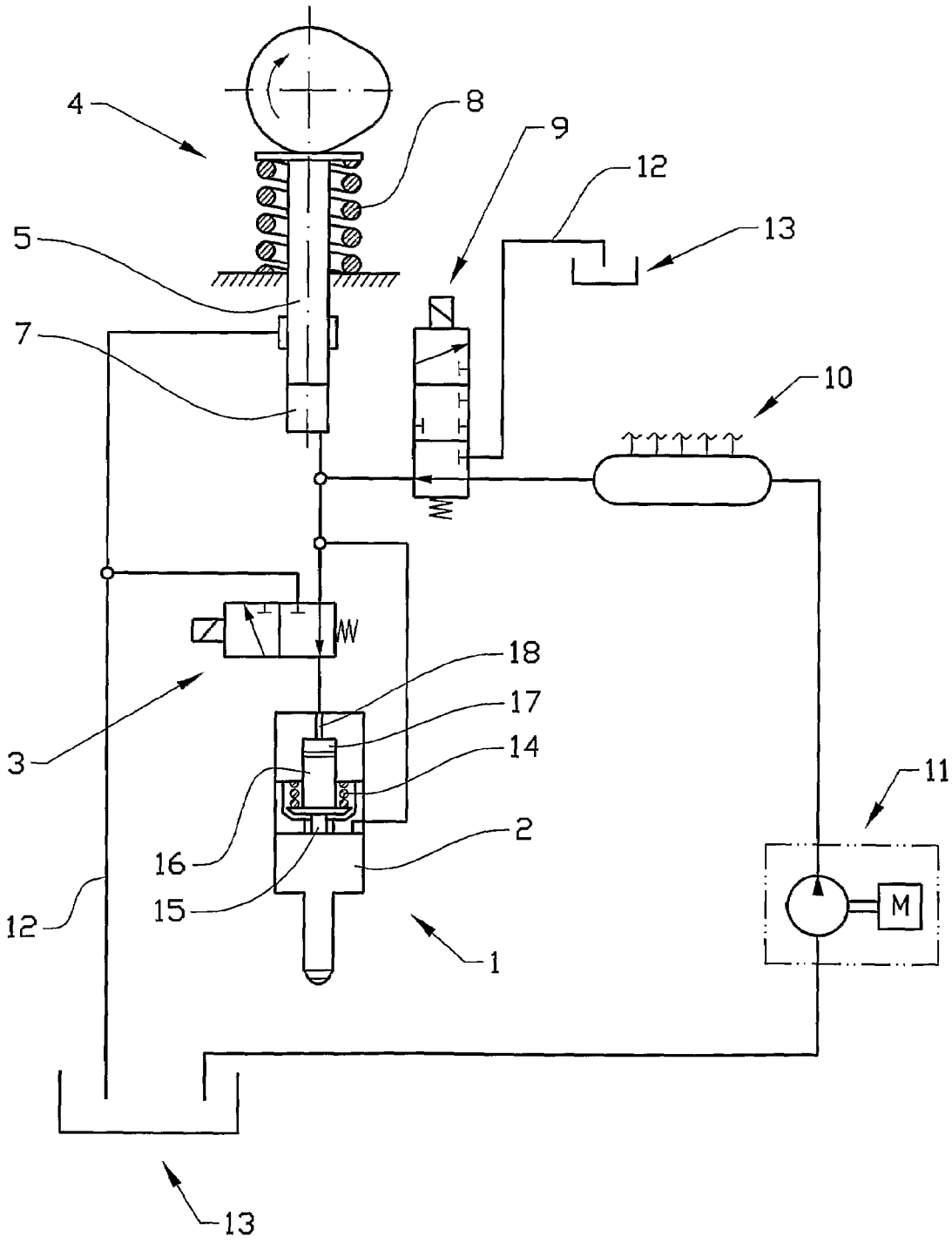

Still another embodiment shown in FIG. 5 incorporates a three position/three-way control valve 9 between the plunger chamber 7 and common rail 10. The control valve 9 can alternatively connect the plunger chamber 7 to the common rail or to the return line 12, or isolate the chamber from both of them. The rest of the design is identical to that shown in FIG. 3. The advantage of configuring the present invention according to the embodiment of FIG. 5 is that a so-called "spill end" of injection can be used where necessary.

The CR mode of operation is achieved by opening the NCV and thereby releasing the pressure from the control chamber 17, which in turn allows the nozzle 2 to open. During a CR-mode injection, fuel is supplied to the nozzle from the common rail through the open control valve 9 as shown in FIG. 5. This position of the valve 9 will be referred to as a first position. Closing the NCV raises the pressure in the control chamber 17 and eventually closes the nozzle. Any fuel displaced by the plunger 5 during the pumping stroke passes back to the common rail through the valve 9, which prevents significant extra pressure from being generated in the system and therefore effectively eliminates wind-up and release of the plunger driving mechanism.

In the EUI mode of operation, the control valve 9 is switched from the first to a second position during the pumping stroke of the plunger 5. In the second position, valve 9 isolates the plunger chamber 7 from both common rail and return line. Pressure in the system then rises and, upon reaching a desired pressure level, the NCV is open allowing the needle 15 to open the nozzle as described above. Fuel injection occurs at a high pressure generated by the plunger. To end an injection, several options are available. Typically, the NCV will close re-pressurizing the control chamber 17. If a pressure-backed end of injection is desired, the control valve 9 can be either left closed in the second position for a period of time corresponding to the closing duration of the nozzle, or switched back to the first position. The nozzle will then be closed at a high pressure in the control chamber 17, which will be assisting the return spring 14 in closing the nozzle quicker. If a spill end of injection is desired, the control valve 9 will be switched to a third position connecting the plunger chamber 7 to the return line 12 and isolating it from the common rail. By this means, the nozzle will be closed with the return spring 14 while fuel pressure in the nozzle is low.

Figure 6:
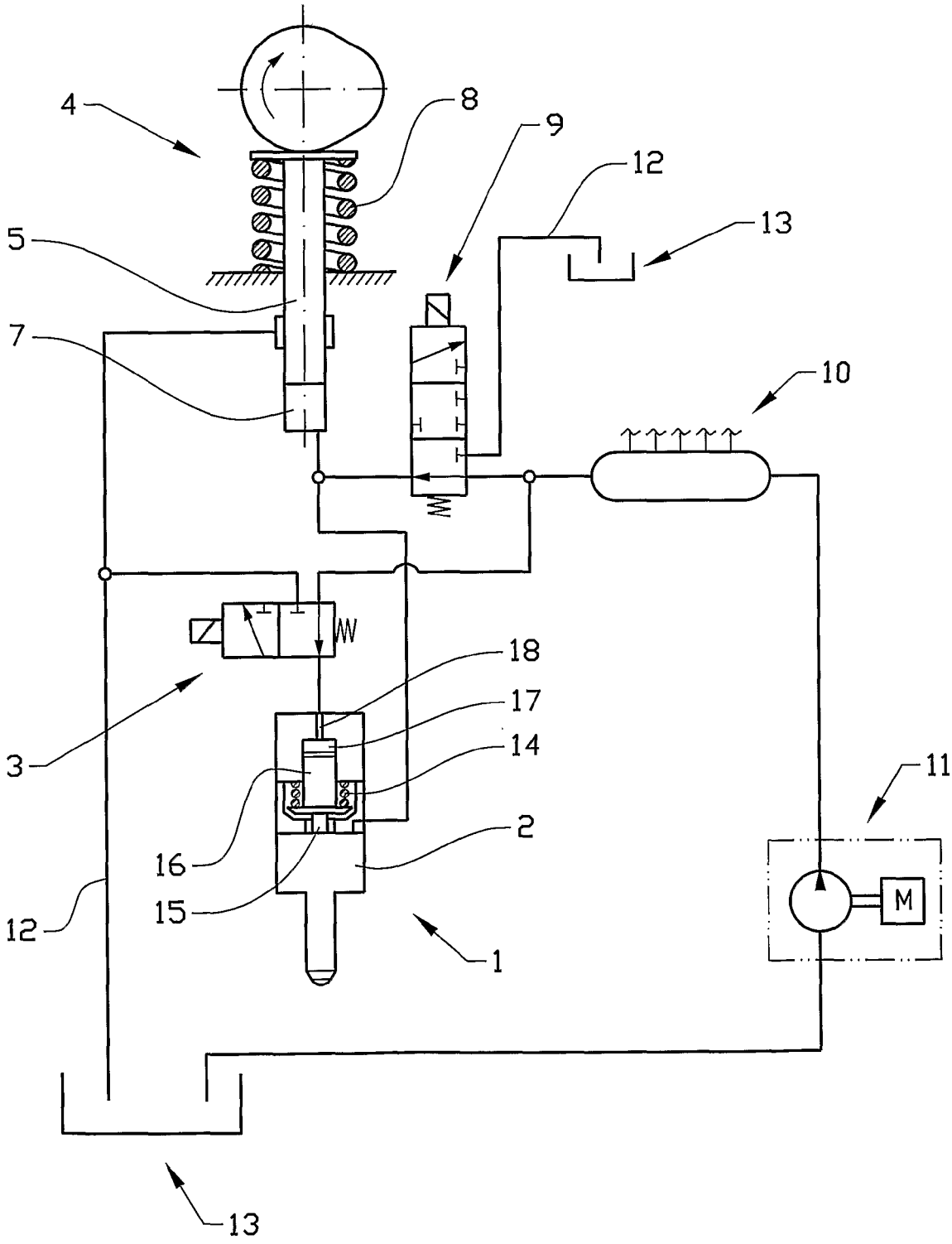

In case a simultaneous use of the spill end and the pressure-backed end of injection is an advantage, the NCV can be connected directly to the common rail as shown in FIG. 6. To end an injection, the NCV is switched to the position where it closes the connection between the control chamber 17 and the return line 12 and connects the control chamber with the common rail. The control valve 9 is switched to the third position to release the pressure from the plunger chamber and the nozzle, and the needle 15 closes the nozzle under the combined action of the return spring 14 and pressure in the control chamber 17. In this embodiment of the present invention, a relatively weak return spring 14 of the nozzle can be used, which can allow for lower minimum common rail pressure setting that can be used for the CR mode of operation.

Figure 7:
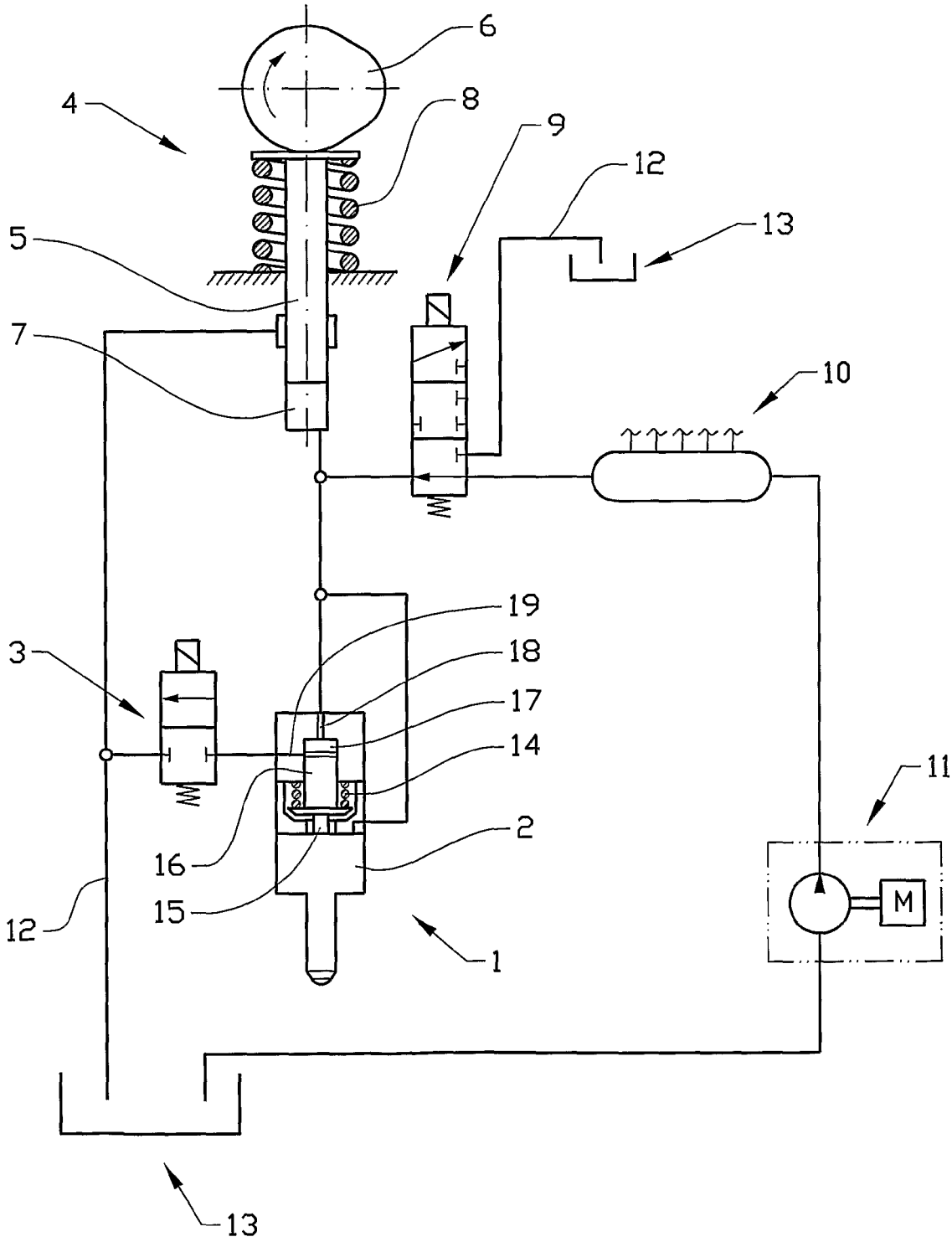
Figure 8:
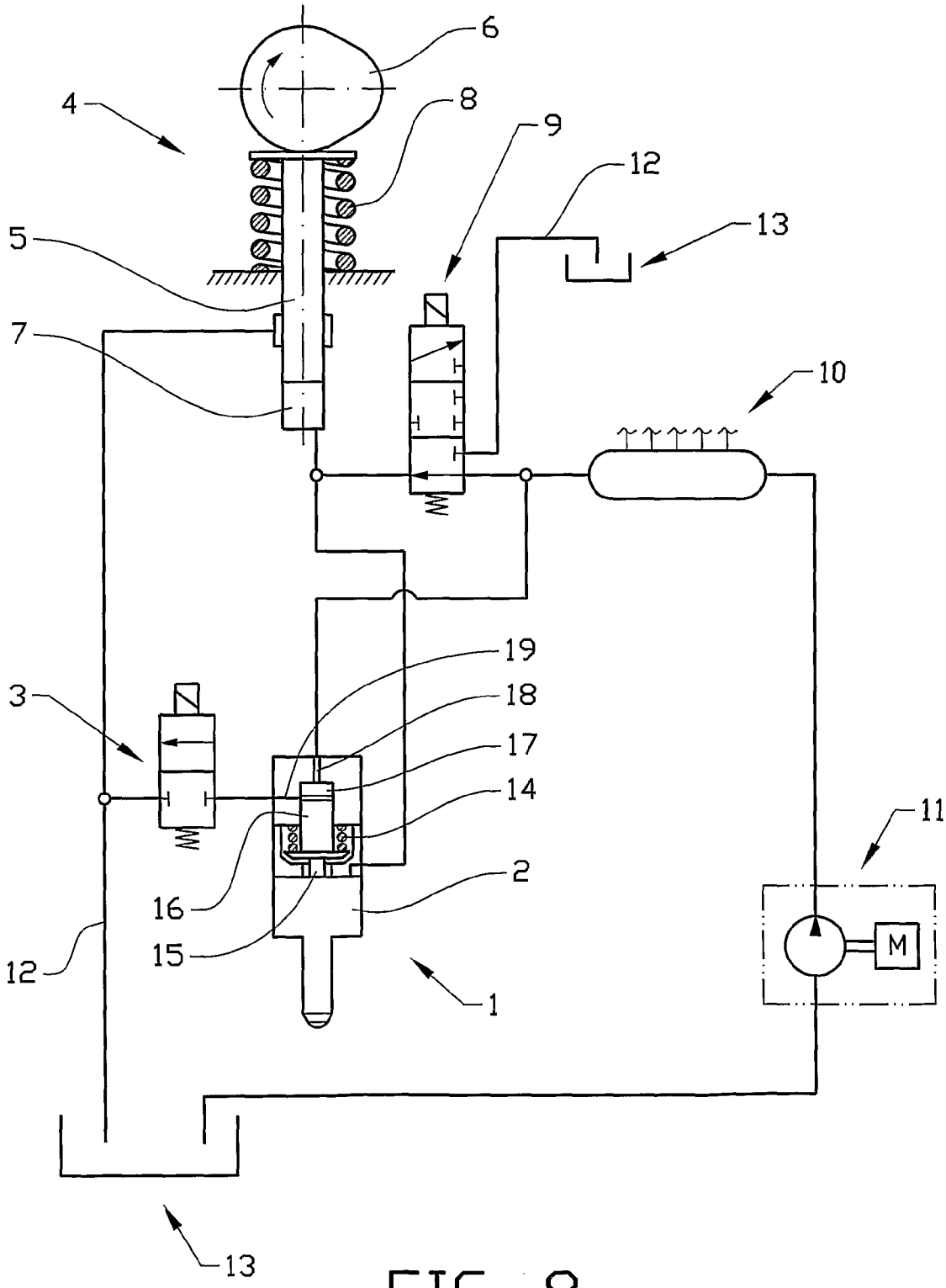

To reduce complexity of the injection systems shown in FIGS. 5 and 6, a two-way nozzle control valve may be used instead of the three-way valve, as shown in FIGS. 7 and 8. The functional sequence of the systems per FIGS. 7 and 8 corresponds to that of the systems depicted in FIGS. 5 and 6 respectively. The design and function of the two-way NCV arrangement is described earlier in this section.

The embodiments of the present invention shown in FIGS. 6 and 8 can be advantageous due to their intrinsically better protection against system overpressure. This is due to the inlet of the control chamber 17 being connected to the common rail (either directly or via NCV) rather than to the plunger chamber 7, as is the case in the other embodiments of the invention (FIGS. 1–5, 7) and in many a prior art design. In these latter systems, a failure of the NCV to open leaves no way for the pressure created during the pumping stroke of the plunger to escape, because pressure build-up occurs simultaneously in the nozzle and in the control chamber 17, and cannot open the nozzle. This can cause serious mechanical damage of the FIE and the engine. Connecting the control chamber 17 to the common rail as in FIGS. 6 and 8 sets a hardware limit to the maximum pressure that can be achieved in the injector with the closed nozzle. This pressure limit is determined by the preload of the return spring 14, diameter of the control piston 16 and pressure in the common rail 10, which in turn can be easily limited by a relief valve.

Figure 9A:
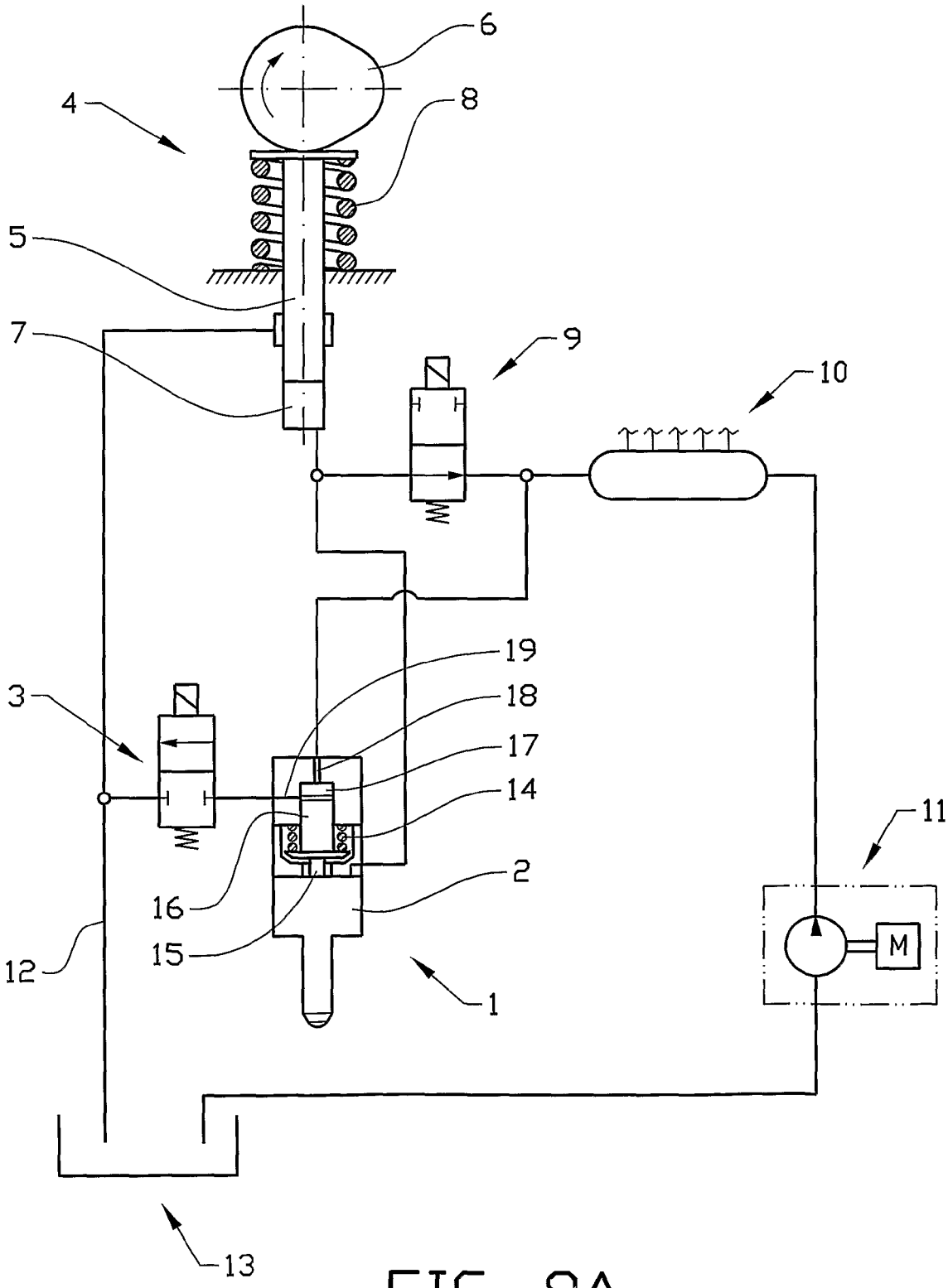

Such principle of hardware limiting of the maximum pressure can be used in any other embodiment of the present invention as described above. An example of this is given in FIGS. 9*a,b*.

Figure 10:
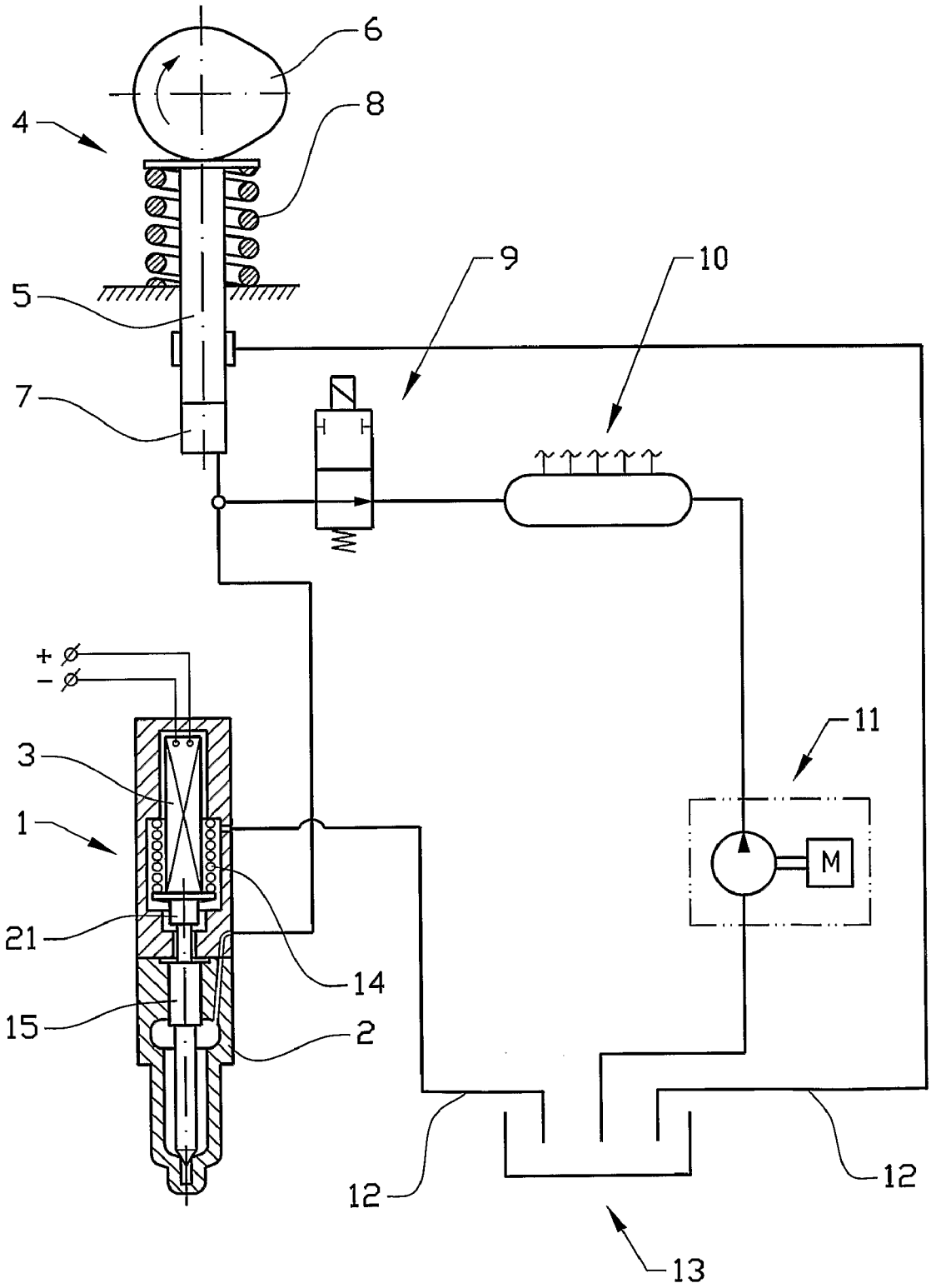

Yet another embodiment of the present invention shown in FIG. 10 incorporates an electrically operated nozzle control valve 3 which directly controls the position of the needle 15 of the nozzle 2. The needle 15 can be mechanically connected to the moveable armature 21 of the NCV 3. The CR and/or the EUI operational modes, as well as their combinations, are realized in this embodiment in the same way as previously described. The NCV can be solenoid-actuated or, preferably, piezo-actuated to achieve fast and precise control of the position of the needle 15.

Figure 9B:
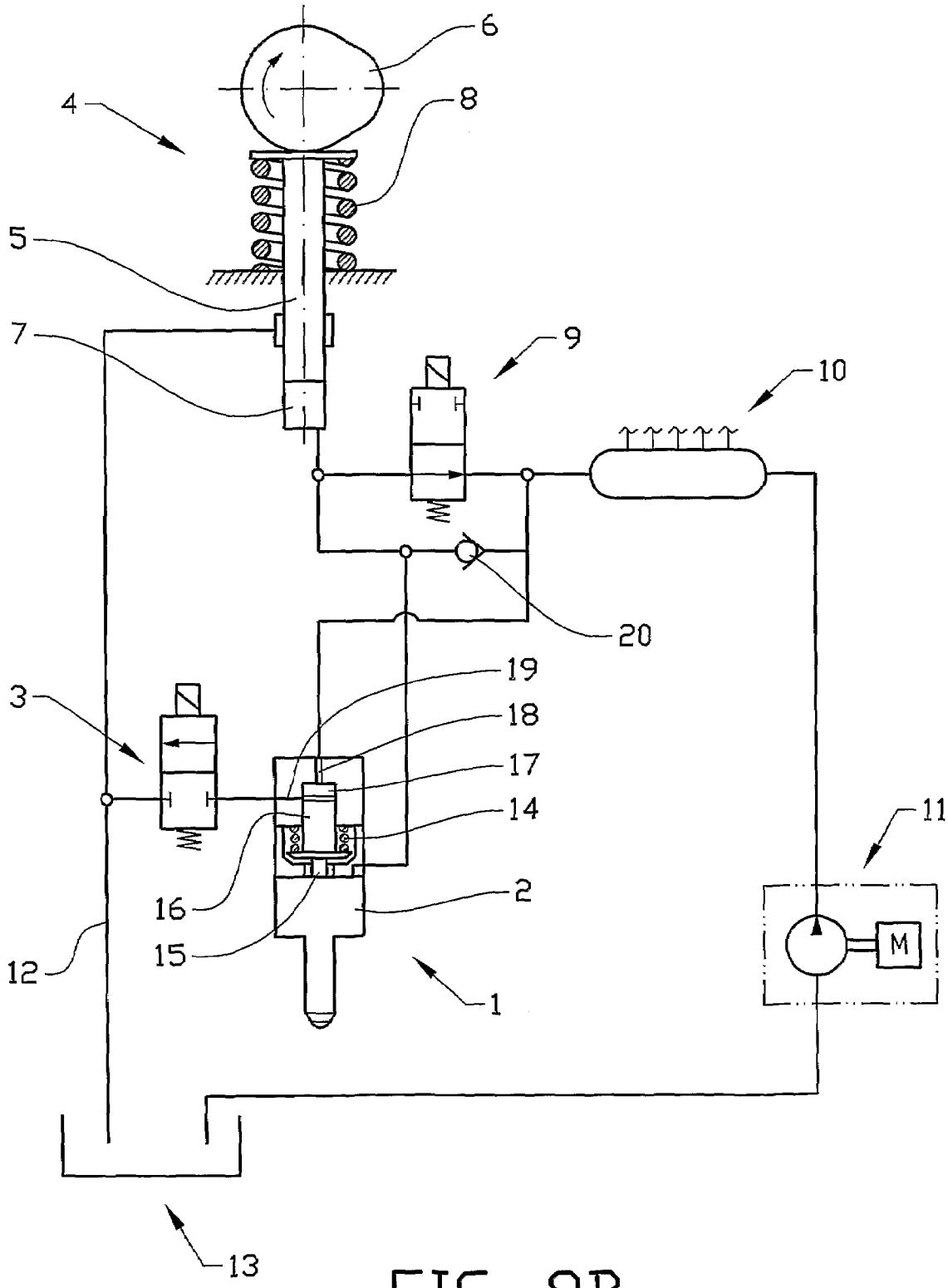

All of the embodiments of the present invention described herein are capable of rate shaping of the injection process in several ways. Variable needle opening pressure (NOP) is achieved during the EUI operational mode by suitably delaying the timing of the opening of the NCV 3 relative to closing of the control valve 9. For the variants shown in FIGS. 6, 8 and 9, high maximum NOP can be set by using the control piston 16 of a bigger diameter than the diameter of the needle Selecting an higher NOP gives a more square-shaped injection rate trace, lower NOP will give a gradual pressure rise during an injection and the trace will have a triangular shape.

Different combinations of multiple injections such as pilot, split and post injections that are known to be possible for both EUI and CR FIE are also achievable by the present invention. Additionally, the invention allows for a boot-shaped injection with variable pressure level and variable duration of the boot phase. To achieve such an injection pattern, both the CR and EUI operational modes can be used within a single injection cycle, with NCV opening prior to the start of pumping stroke of the plunger.

The means 11 for pressurizing the common rail 10 and regulating the fuel pressure can incorporate a fixed displacement pump and a pressure regulator that is essentially a controllable relief valve. The displacement of the pump is chosen such that maximum required pressure in the CR can be achieved at any engine operating condition. When a lower pressure is required compared to what is achievable at the particular condition, the relief valve will return the excess fuel from the outlet of the pump back to the fuel tank. Alternatively, a variable displacement pump can be used such that the delivery of the pump can be adjusted at any operating condition to maintain necessary CR pressure without opening a relief valve, which in such a system will function as a safety relief valve. The use of a variable displacement pump will allow reduced power losses, but such pumps are generally more expensive than fixed displacement pumps. Other configurations of the means 11 can be utilized in the present invention, for example, a fixed displacement pump driven by the engine via a variable ratio transmission, either mechanical, hydro-mechanical or electrical. In the latter case the starter motor of the engine can be used for the purpose, thereby avoiding the cost of an additional dedicated electrical motor for the pump.

While the present invention has been disclosed in connection with the preferred embodiments thereof, it should be understood that there might be other embodiments that fall within the spirit and scope of the invention as defined by the following claims.

The invention claimed is:

1. A fuel injection system for an internal combustion engine comprising:

a nozzle (2) with an inlet; a cam-driven plunger (5) forming a plunger chamber (7) said plunger chamber connected to the inlet of the nozzle;

a common rail (10) for fuel; a control valve (9)between the plunger chamber (7) and the common rail (10), said control valve being able to open or close hydraulic communication between the plunger chamber and the common rail upon receiving an electrical control command;

an electrically operated nozzle control valve (3) for opening and closing of the nozzle (2);

a pressuring means (11) for pressurizing the common rail and regulating pressure of the fuel in the common rail (10); and a fuel tank (13).

2. The fuel injection system as recited in claim 1, wherein a non-return valve (20) is installed between said plunger chamber (7) and the common rail (10), with the inlet of said non-return valve connected to the common rail.

3. The fuel injection system as recited in claim 1, wherein said control valve (9) isolates said plunger chamber (7) from the common rail (10) and connects the plunger chamber (7) to the return line (12) while in a third position; isolates the plunger chamber (7) from both the return line (12) and the common rail (10) while in a second position; isolates the plunger chamber (7) from the return line (12) and connects the plunger chamber (7) to the common rail (10) while in a first position.

4. A fuel injection system comprising a nozzle (2) with an inlet and a needle (15); a resilient means (14) biasing the needle to close the nozzle; a control piston (16) forming a control chamber (17) with an input throttle (18) and an outlet port (19), said control piston abutting the needle (15) such that an higher pressure in the control chamber (17) tends to urge the control piston (16) onto the needle to close to the nozzle; a cam-driven plunger (5) forming a plunger chamber (7), said plunger chamber connected to the input throttle (18) and the inlet of the nozzle (2); a common rail (10) for fuel; a control valve (9) installed between the plunger chamber (7) and the con-rn-ion rail (10), said control valve (9) being able to open or close hydraulic communication between the plunger chamber and the common rail upon receiving an electrical control command; a nozzle control valve (NCV) (3) installed between the outlet port (19) of the control chamber (17) and a return line (12), said NCV being able to open or close hydraulic communication between the outlet port (17) and the return line (12); a pressuring means (11) for pressurizing the common rail and regulating pressure of the fuel in the common rail; a fuel tank (13); said fuel injection system characterized in that the effective flow areas of said input throttle (18), outlet port (19) and the NCV (3) and the force of the resilient means (14) are chosen such that an opening of the NCV can cause the needle (15) to open the nozzle when the pressure at the inlet of the nozzle is below a maximum working pressure of the common rail.

5. The fuel injection system as recited in claim 4, wherein a non-return valve (20) is installed between said plunger chamber (7) and the common rail (10), with the inlet of said non-return valve connected to the common rail.

6. The fuel injection system as recited in claim 4, wherein said control valve (9) isolates said plunger chamber (7) from the common rail (10) and connects the plunger chamber (7) to the return line (12) while in a third position; isolates the plunger chamber (7) from both the return line (12) and the common rail (10) while in a second position; isolates the plunger chamber (7) from the return line (12) and connects 15 the plunger chamber (7) to the common rail (10) while in a first position.

7. The fuel injection system as recited in claim 4, wherein said outlet port (19) and the control piston (16) are designed such that the control piston (16) is able to restrict the flow area of the outlet port (19) at a position corresponding to an open nozzle (2), thereby limiting the leakage of pressurized fuel through the input throttle (18), output port (19) and open NCV (3) to the return line (12).

8. A fuel injection system comprising a nozzle (2) with an inlet and a needle (15); a resilient means (14) biasing the needle (15) to close the nozzle (2); a control piston (16) forming a control chamber (17) and abutting the needle (15) such that an higher pressure in the control chamber (17) tends to urge the control piston (16) onto the needle (15) to close the nozzle (2); a cam-driven plunger (5) forming a plunger chamber (7), said plunger chamber connected to the inlet of the nozzle (2); a common rail (10) for fuel; a control valve (9) installed between the plunger chamber (7) and the common rail (10), said control valve being able to open or close hydraulic communication between the plunger chamber and the common rail upon receiving an electrical control command; a nozzle control valve (NCV) (3), said NCV being able to isolate said control chamber (17) from a return line (12) and open hydraulic communication between said plunger chamber (7) and the control chamber (17) while in a first position and being able to isolate the control chamber (17) from the plunger chamber (7) and hydraulically connect the control chamber (17) to the return line (12) while in a second position; a pressuring means for pressurizing the common rail (10) and regulating pressure of the fuel in the common rail; a fuel tank (13); said fuel injection system characterized in that the pressure in the common rail (10) can be set sufficiently high to overcome the force of the resilient means (14) and open the nozzle (2) when the NCV (3) is in its second position.

9. The fuel injection system as recited in claim 8, wherein a non-return valve (20) is installed between said plunger chamber (7) and the common rail (10), with the inlet of said non-return valve connected to the common rail.

10. The fuel injection system as recited in claim 8, wherein said control valve (9) isolates said plunger chamber (7) from the common rail (10) and connects the plunger chamber (7) to the return line (12) while in a third position; isolates the plunger chamber (7) from both the return line (12) and the common rail (10) while in a second position; isolates the plunger chamber (7) from the return line (12) and connects the plunger chamber (7) to the common rail (10) while in a first position.

11. The fuel injection system as recited in claim 8, wherein said NCV (3) isolates said control chamber (17) from the return line (12) and opens hydraulic communication between said control chamber (17) and the common rail (10) while in the first position; and isolates the control chamber (17) from the common rail (10) and hydraulically connects the control chamber (17) to the return line (12) while in the second position.

12. The fuel injection system as recited in claim 1, wherein the pressuring means (11) for pressurizing the common rail (10) comprise an hydraulic pump of a variable displacement type and a control means for controlling the displacement of said pump to achieve desired pressure in the common rail.

13. The fuel injection system as recited in claim 1, wherein the pressuring means for pressurizing the common rail (10) comprise an hydraulic pump of a fixed displacement type and a control means for controlling the rotational speed of said pump to achieve desired pressure in the common rail.

14. The fuel injection system as recited in claim 13, wherein said hydraulic pump is driven by the starter motor of the engine.

15. The fuel injection system as recited in claim 1, wherein the pressure in the common rail (10) can be set to a maximum value of 600 bar.

* * * * *